United States Patent [19]

Carminati et al.

[11] Patent Number: 4,639,955

[45] Date of Patent: Feb. 3, 1987

[54] DEVICE FOR MOVING A PATIENT FROM HIS BED

[75] Inventors: Armelle Carminati, 47 rue des Marmuzots, 21000 Dijon; Edouard de Buyer, 9 rue des Pommerelles, 60200 Compiegne; Nicolas Monomakhoff, 10 rue Firmin Gillot, 75015 Paris; Roland Chanut, 108 route de la Douane, 69126 Brindas, all of France

[73] Assignees: Armelle Carminati, Dijon; Edouard de Buyer, Compiegne; Nicolas Monomakhoff, Paris, all of France

[21] Appl. No.: 760,031

[22] Filed: Jul. 29, 1985

[30] Foreign Application Priority Data

Aug. 2, 1984 [FR] France ..... 84 12439

[51] Int. Cl.[4] ..... A61G 7/08

[52] U.S. Cl. ..... 5/81 B; 5/83; 5/89; 414/921

[58] Field of Search ..... 5/81 R, 81 C, 81 B, 5/82 R, 82 B, 83–89, 424, 425, 427–430; 212/205; 414/921

[56] References Cited

U.S. PATENT DOCUMENTS

| | | | |
|---|---|---|---|
| 2,368,390 | 1/1945 | Winter | 5/86 |
| 2,988,753 | 6/1961 | Corvelli | 5/157 |
| 3,234,568 | 2/1966 | Fischer | 5/89 |
| 3,732,584 | 5/1973 | James | 5/81 R |
| 4,125,908 | 11/1978 | Vail et al. | 5/86 |
| 4,138,750 | 2/1979 | Michalowski | 5/81 R |
| 4,202,063 | 5/1980 | Murray | 5/81 R |
| 4,202,064 | 5/1980 | Joergensen | 5/83 |
| 4,243,147 | 1/1981 | Twitchell et al. | 212/159 |
| 4,372,452 | 2/1983 | McCord | 5/85 |
| 4,387,473 | 6/1983 | Gettner | 5/81 B |
| 4,446,587 | 5/1984 | Jump | 5/83 |

FOREIGN PATENT DOCUMENTS

| | | | |
|---|---|---|---|
| 1235844 | 5/1960 | France . | |
| 2461492 | 2/1981 | France . | |
| 616783 | 10/1958 | Italy | 212/205 |
| 3894 | of 1915 | United Kingdom . | |
| 1564891 | 4/1980 | United Kingdom . | |

*Primary Examiner*—John E. Murtagh
*Assistant Examiner*—Andrew Joseph Rudy
*Attorney, Agent, or Firm*—Parkhurst & Oliff

[57] ABSTRACT

This invention relates to a device for moving a patient, of the type comprising: a support adapted to receive the body of the patient, a trolley comprising a motor actuating cables connected to the support for lifting the support loaded with the patient's body vertically then for translating it horizontally, at least one rail for translation over which said trolley moves; wherein, on the one hand, said support, adapted to receive the patient's body, is constituted by a supple cloth, in one piece, comprising at least three successive distinct parts: a first part adapted to receive and to maintain the patient's head, a second part adapted to receive and to maintain the patient's body, a third part adapted to receive and to maintain the patient's legs; and wherein, on the other hand, the trolley mobile over at least one rail comprises: a first pair of cables connected to the first part of the support, a second pair of cables connected to the third part of the support, a first, so-called lifting motor for controlling the movement of lifting and lowering of these two pairs of cables, a second, so-called translation motor for controlling the action of horizontal translation of this trolley.

15 Claims, 13 Drawing Figures

DEVICE FOR MOVING A PATIENT FROM HIS BED

The invention relates to a device for displacing a patient from his bed, and relates more particularly to a device enabling a patient, such as a handicapped, impotent or elderly person, to move by himself between a plurality of predetermined positions, in particular from his bed.

At present, when such a handicapped patient wishes to move between several positions, he requires assistance from a third party. This is expensive, the handicapped person is dependent on this third party and, finally, for the patient, such transfers are not very comfortable.

U.S. Pat. No. 4,202,064 describes a device for the horizontal and vertical transport of a patient, essentially constituted by a trolley movable over two orthogonal sets of two parallel rails and by a hoist controlling by cables a support in the form of a cradle adapted to receive the body of the patient. In this embodiment, the motor of the hoist is supplied with electricity by the rails themselves and the shaft of the motor of this hoist presents an end-of-stroke block stop. The assembly is actuated with the aid of control ropes on which the patient or nursing staff pulls. This arrangement is expensive, cumbersome, unaesthetic and difficult to manipulate either by the patient himself, especially if he is bed-ridden, or by the nursing staff. In addition and in particular, this apparatus requires:

on the one hand, that the patient must make an effort to hold up his head during the translation and lifting operations;

on the other hand, that the nursing staff must make efforts of handling to introduce the cradle-shaped support under the patient.

Lastly, due to the very cradle-like structure of the support, the patient is not in an ergonomic position during transport, particularly due to the presence of a bar at knee level.

U.S. Pat. Nos. 4,125,908, 4,243,147 and 4,372,452 propose other similar solutions which nevertheless still present the same drawbacks. Consequently, these devices have hardly been developed.

British Patent No. 3894 discloses a device of the type in question constituted by a gantry and a rigid patient-holder formed by two articulated but lockable portions actuated by a crank which, thanks to two pairs of cables, ensure lifting of said articulated portions. Once the patient is lifted in this way, the gantry is rolled over the floor towards the chosen spot. This is therefore a wholly mobile device, which is therefore cumbersome, modulatable only with difficulty, uncomfortable for the patient and giving no independence to this patient.

It is an object of the invention to overcome these drawbacks and it relates to this end to a device for moving a patient, particularly a handicapped person, from his bed, which is reliable, hygienic, aesthetic, low in cost, operationally reliable, modular by construction, therefore easily adaptable to different sites, and lastly which may be actuated by the patient himself.

This device for moving a patient, of the type comprising:

a support adapted to receive the body of the patient, a trolley comprising a motor actuating cables connected to said support for lifting this support loaded with the patient's body vertically then for translating it horizontally, at least one rail for translation over which said trolley moves, is characterized:

on the one hand, in that said support adapted to receive the patient's body, is constituted by a supple cloth, in one piece, comprising at least three successive distinct parts, namely:

a first part adapted to receive and to maintain the patient's head, a second part adapted to receive and to maintain the patient's body, a third part adapted to receive and to maintain the patient's legs;

on the other hand, in that the trolley mobile over at least one rail comprises:

a first pair of cables connected to the first part of the support, a second pair of cables connected to the third part of the support, a first, so-called lifting motor for controlling the movement of lifting and lowering of these two pairs of cables, a second, so-called translation motor for controlling the action of horizontal translation of this trolley.

In other words, the invention provides a device of the type in question in which the supple support is constituted in one piece composed of a plurality of distinct parts, which is actuated by a single lifting motor, the movement of horizontal translation of the whole being obtained by another motor borne by the same mobile trolley capable of moving over at least one rail.

Advantageously, in practice:

the first motor controlling the vertical displacement is fastened on the trolley and is associated with a speed-reducing gear of which the driven shaft comprises two sets each formed by three parallel cheeks, each thus defining two pairs of drums on which are wound the cables of the two pairs associated with the support;

this first motor actuates the lifting cables, which, by a previous differential adjustment, firstly drive the first part of the support in order to bring the patient into sitting position, then the third part of this same support, thus enabling the whole of the patient's body to be lifted into sitting position;

the trolley moves over two transverse parallel rails and comprises:

wheels which roll on the top of said rails, lateral guiding wheels which roll on the inner lateral face of these rails;

the second motor for controlling the horizontal translation drives a pulley which, by a driving belt, transmits the movement to a second pulley mounted on a the cables are supple cables made of steel or synthetic material;

the assembly also comprises devices for controlling the action of the two motors and the movements of vertical and horizontal displacement;

the second part of the support cloth is divided into two sections, one which is adapted to be wound around the patient's chest, the other to receive the patient's back and bottom;

the supple cloth for carrying the patient is made of cotton and is permanently spread over the bed under the patient.

The invention will be more readily understood on reading the following description with reference to the accompanying drawings, in which.

Figure 1:
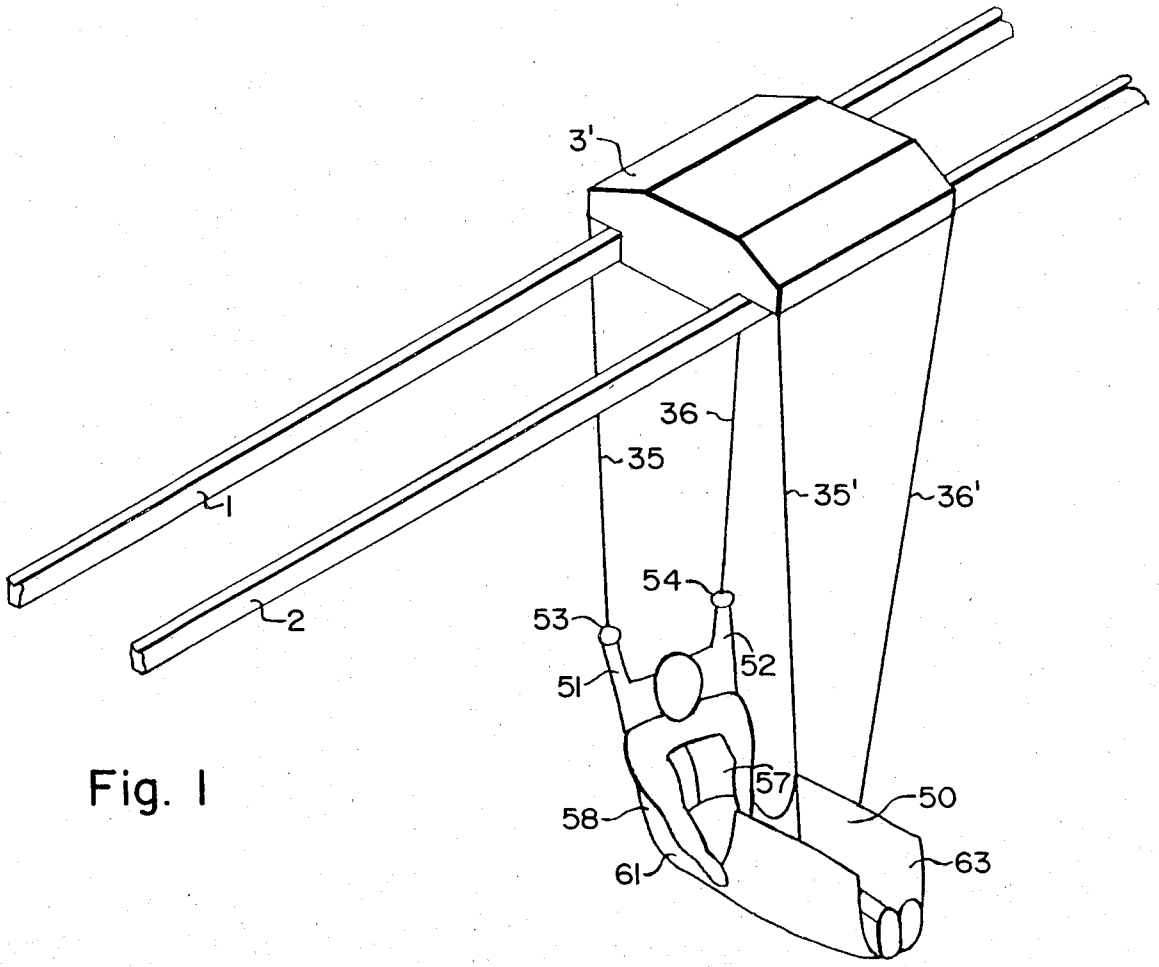
FIG. 1 is a summary perspective view of a device according to the invention.

Referring now to the drawings, the device according to the invention (cf. FIG. 1) essentially comprises two parallel rails 1 and 2, for example made of bent sheet steel, over which a trolley 3 moves. These rails 1 and 2 are fixed to the wall or the ceiling by their ends and by conventional means (not shown). In a particular embodiment, these rails may also be fixed to a gantry standing on the floor.

Figure 6:
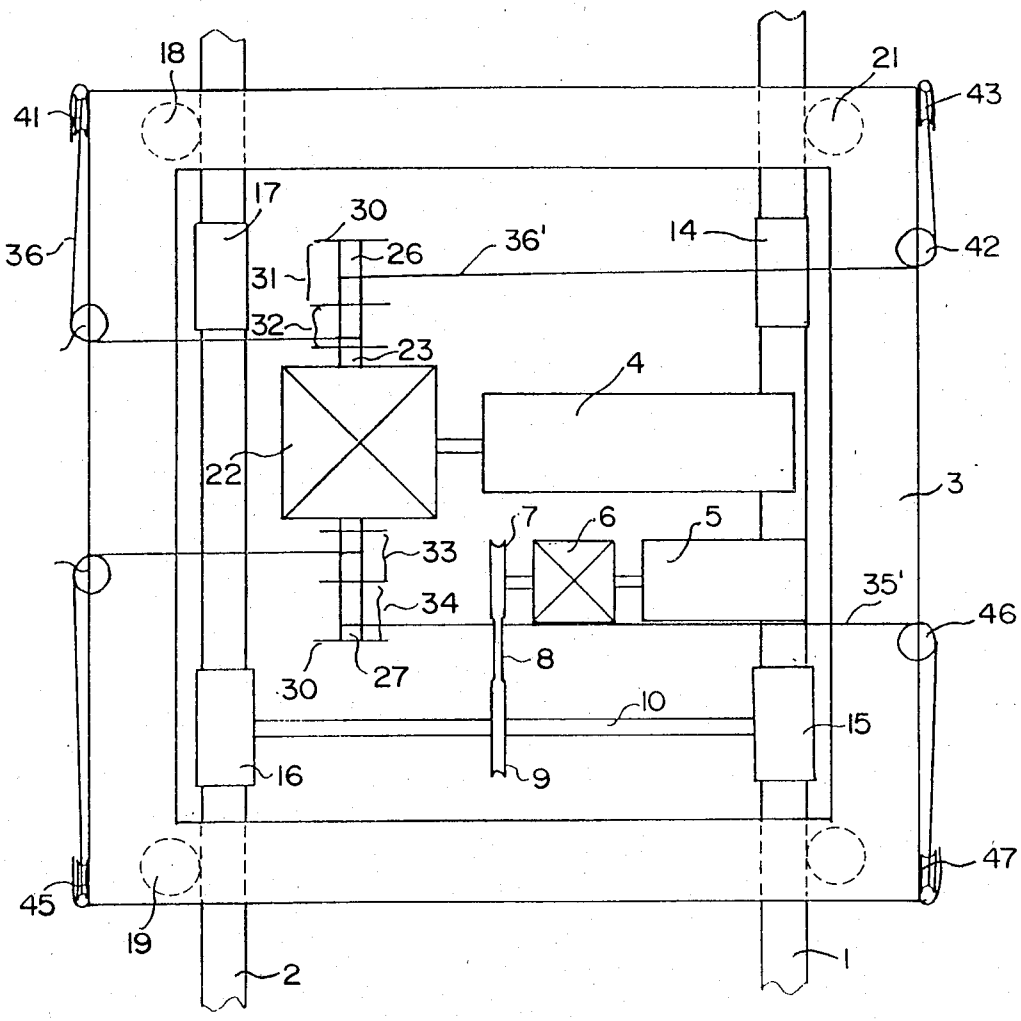
FIG. 6 is a view of the trolley, which is characteristic of the invention, in plan view, in front view (FIG. 7) and lastly in side view (FIG. 8).
Figure 7:
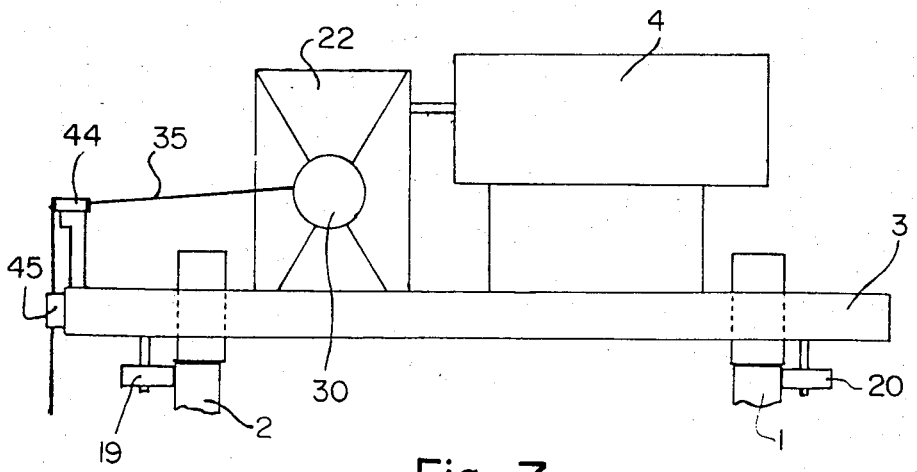
Figure 8:
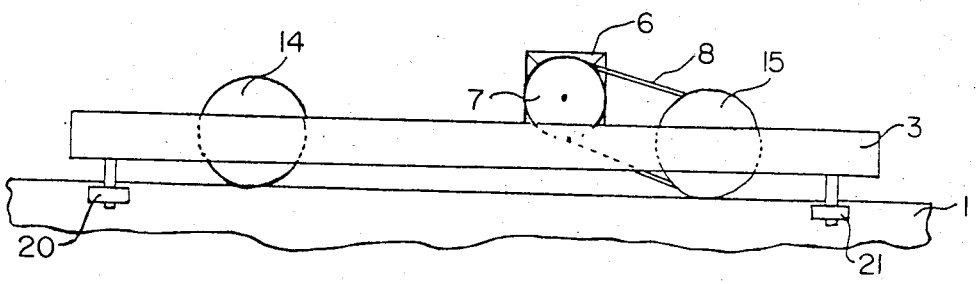

This trolley 3, shown symbolically in the form of a rigid frame (cf. FIGS. 6, 7 and 8 in particular), essentially bears two distinct motors 4 and 5, respectively:

a first motor 4 for lifting (Y), coupled to a speed reducing gear 22, irreversible in order to avoid the weight of the patient's body pulling this patient downwards during stops; this motor 4 has two directions of operation in order to allow ascension and descent; it comprises a progressive start-up and is supplied from the mains for reasons of economy and convenience; lastly, this motor 4 also comprises conventional safety devices (not shown);

a second motor 5 for horizontal translation (X), monophased, supplied from the mains, likewise with two directions of operation and with progressive start-up.

This motor 5 for horizontal translation (X) is associated with a speed reducing gear 6 of which the driven shaft drives a pulley 7 which, thanks to a trapezoidal belt 8, drives, in turn, a second pulley 9 mounted on a shaft 10 connecting the driving wheels 15 and 16 of this trolley 3. For reasons of convenience, and to facilitate understanding, this trolley 3 has been shown, as mentioned hereinbefore, in the form of a rigid frame. In fact, this trolley essentially comprises two parts, namely a carrying structure such as the rigid frame 3 itself forming trolley proper and a cover 3' (cf. FIG. 1). This trolley 3 comprises:

on the one hand, wheels 14, 15, 16, 17 which roll on the top of the rails 1, 2, particularly rubber wheels, driven (14, 17) and driving (15, 16) respectively;

on the other hand, lateral guiding wheels 18, 19, 20, 21, likewise made of rubber, for ensuring lateral maintenance of the trolley 3 against the inner lateral faces of the rails 1 and 2.

In this way, the trapezoidal belt 8 driven by the pulley 7 transmits the movement to the pulley 9 mounted on shaft 10 fixed to trolley 3 which connects together the driving wheels 15 and 16 of the trolley 3. In this way, this trolley 3 translates horizontally (X) thanks to its rubber wheels.

Figure 9:
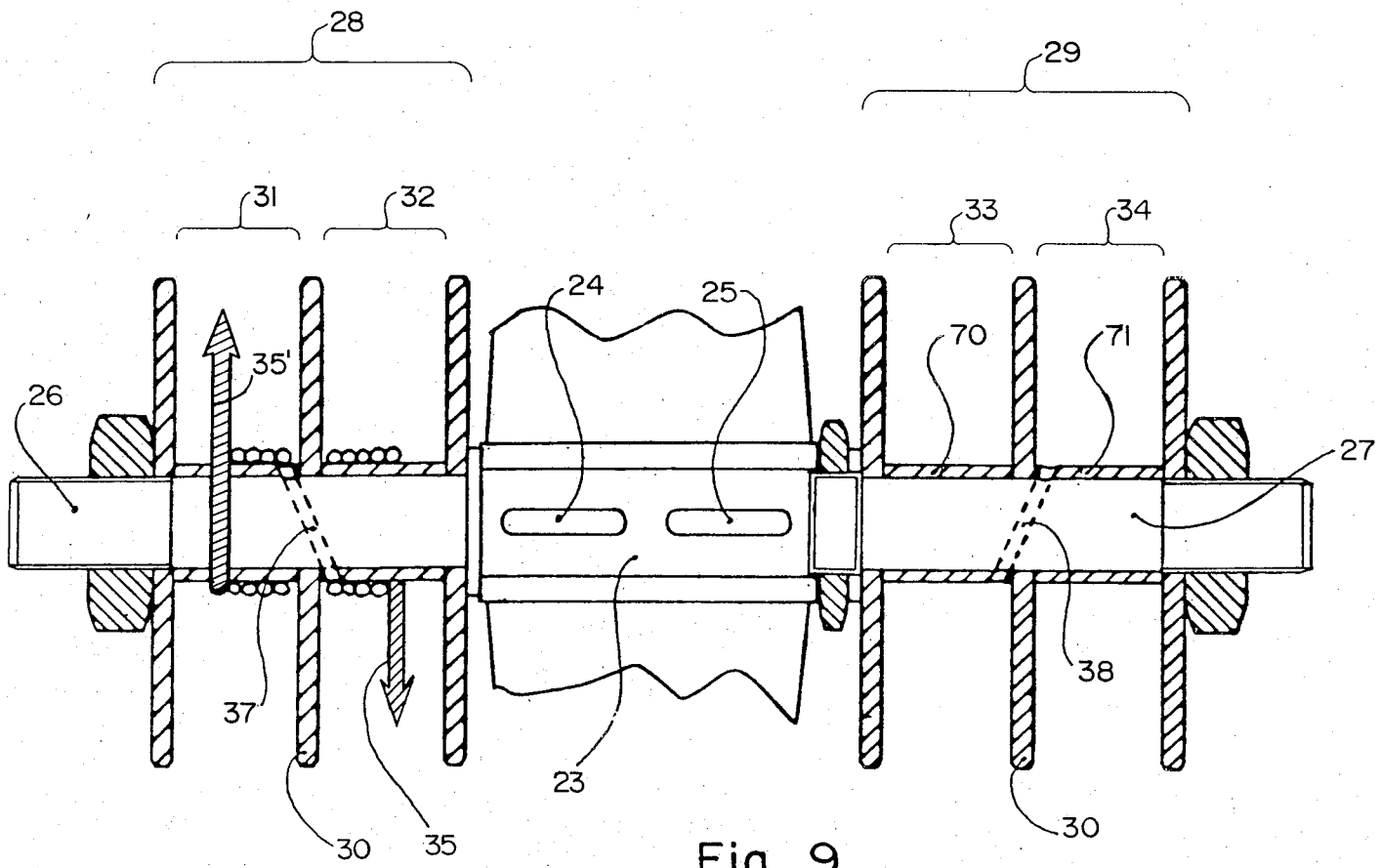
FIG. 9 shows the driven shaft of the lifting motor in detail.
Figure 11:
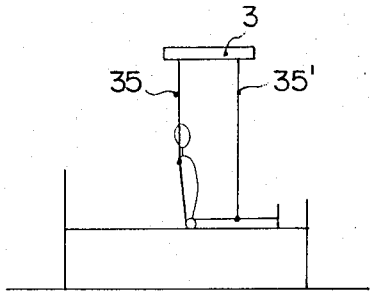
FIGS. 10 to 13 illustrate different arrangements of this device during operation.

The motor 4 for lifting (Y) incorporating variator is also associated with a speed reducing gear 22 which presents a driven shaft 23 (cf. FIG. 9) fitted on the speed reducing gear 22 by pegs 24 and 25. This shaft 23 projects on each side of the gear 22. On each of the projecting portions 26, 27, there is fitted an assembly 28, 29 formed by three parallel cheeks 30 and struts 70, 71, so as to define four drums 31, 32, 33, 34 for winding the lifting cables 35, 36, 35', 36'. Two chanels 37,38 allow passage of the first cable 35 from drum 31 to drum 32 and passage of the other cable 36 from drum 33 to drum 34. These passages thus make it possible to reverse the direction of winding of the front and rear relative lengths of these cables 35, 36, 35', 36'.

These lifting cables 35, 36, 35', 36' are made of flexible steel or any other equivalent material, such as for example textile ropes.

As will be understood hereinafter, drum 31 serves for example to ensure winding of that part of the cable 35 which controls the lifting of the right leg, drums 32, 33 that of the chest and drum 34 that of the left leg.

References 35' or 36' denote the portion of the lifting cables 35, 36 disposed towards the patient's legs.

On leaving the shaft 23, the cable 36 passes firstly over a horizontal guiding pulley 40 then over a vertical guiding pulley 41 and descends vertically. Symmetrically, cable 36' passes over a horizontal pulley 42 and a vertical pulley 43.

Cable 35 and 35' follows a substantially symmetrical path over pulleys 44, 45, 46, 47.

Figure 2:
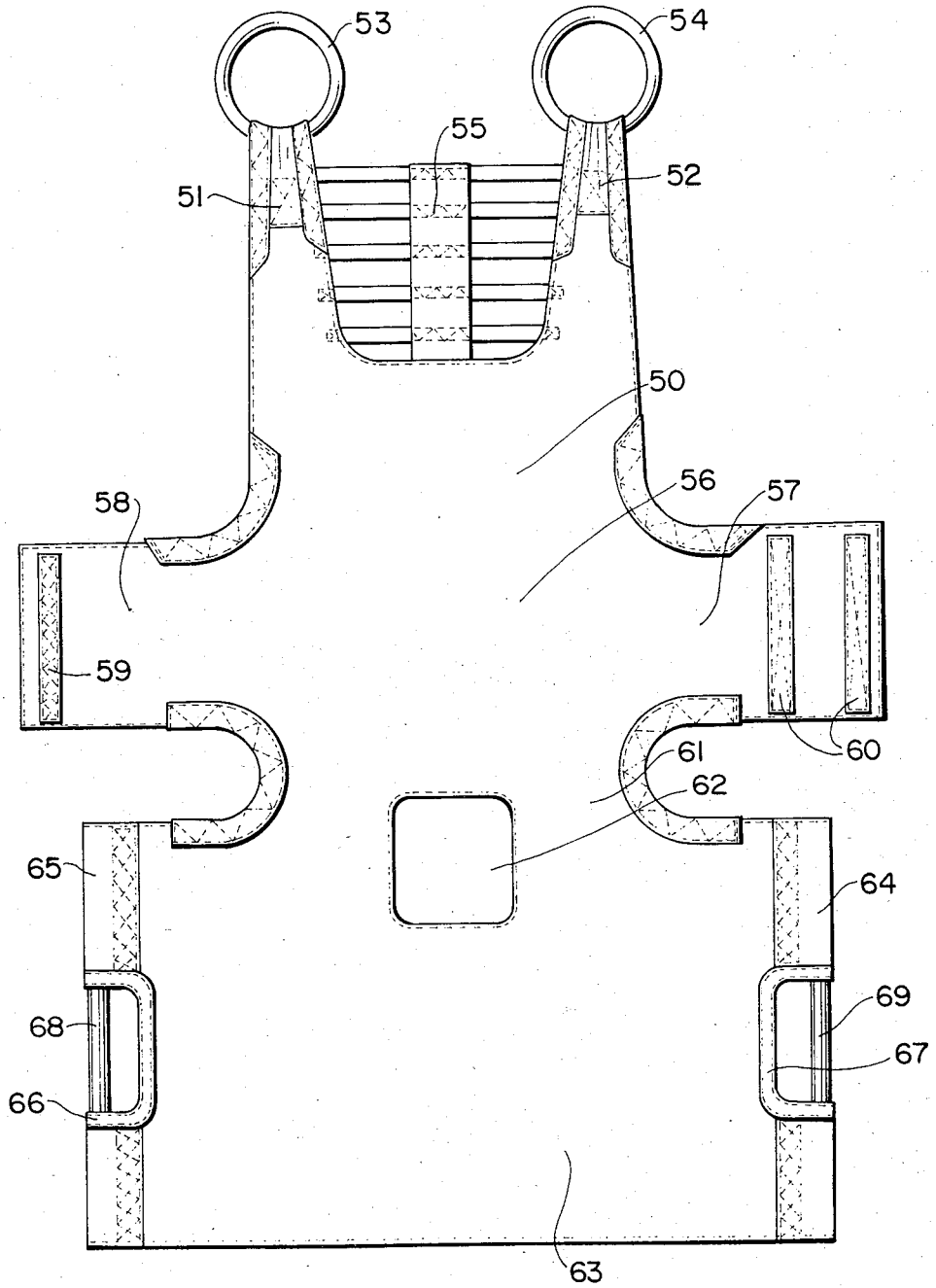
FIG. 2 is a plan view of the patient-carrying support mechanism of the invention.

The patient-carrying support 50 (cf. FIG. 2), characteristic of the invention, is constituted by a cloth which is supple, resistant, uncreasable in order to avoid bedsores, robust to support the patient during transport, easy to wash, sterilizable, comfortable and sufficiently enveloping to avoid the patient tipping over. Cotton, particularly denim, fabrics are advantageously used, possibly lined with an anti-bedsore molleton.

This support 50 essentially comprises two belts 51, 52 which, by removable rings 53, 54, are connected to the lifting cables 35, 36. A first elastic part 55 serves as head-rest. The support then comprises a second part 56 formed by two projecting elementary portions 57, 58, disposed just below the arms and designed for enveloping the chest. The ends 59, 60 of these bands are formed by fastening devices, such as "Velcro" (Registered Trademark) strips. With this part 56 is contiguous a third intermediate part 61 adapted to receive the patient's back and bottom, in which an orifice 62 may be made, covered or not with another fabric, intended to allow the faeces to be evacuated. Lastly, the support 50 comprises a fourth part 63 designed for receiving the patient's legs, the edges 64, 65 forming gussets to receive removable rods. Orifices 66, 67 let the middle of these rods 68, 69 free from obstacles to allow the ends of cables 35',36' to be connected by known means.

Figure 3:
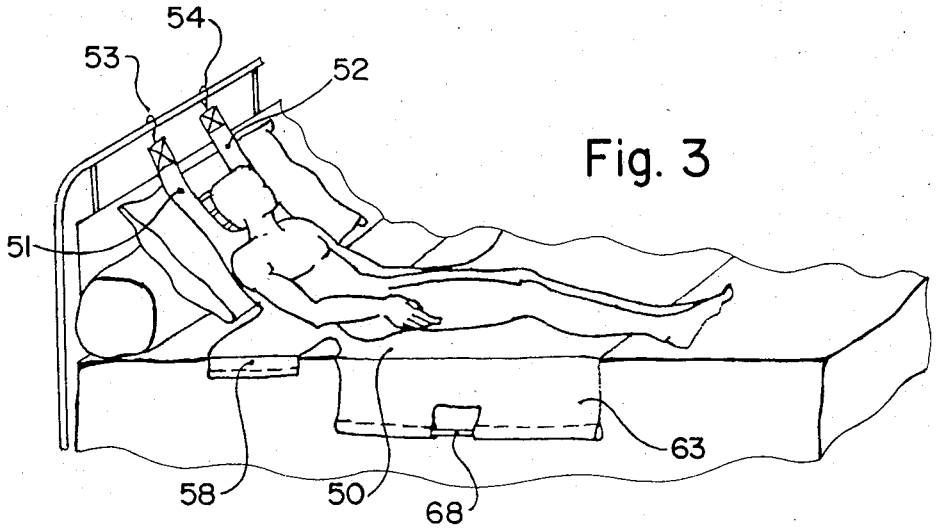
FIGS. 3, 4 and 5 show different views of the lifting phase.
Figure 10:
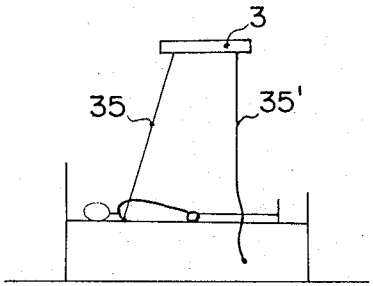
Figure 12:
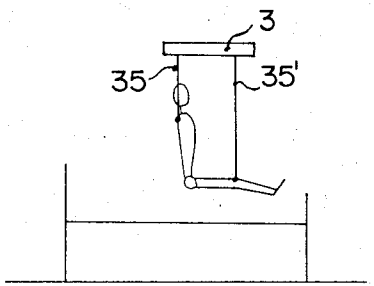

When the patient is in his bed (cf. FIGS. 3 and 10), he lies permanently on the cloth 50 and the removable rings 53, 54, are fixed for example to the upper uprights of the bed.

Figure 4:
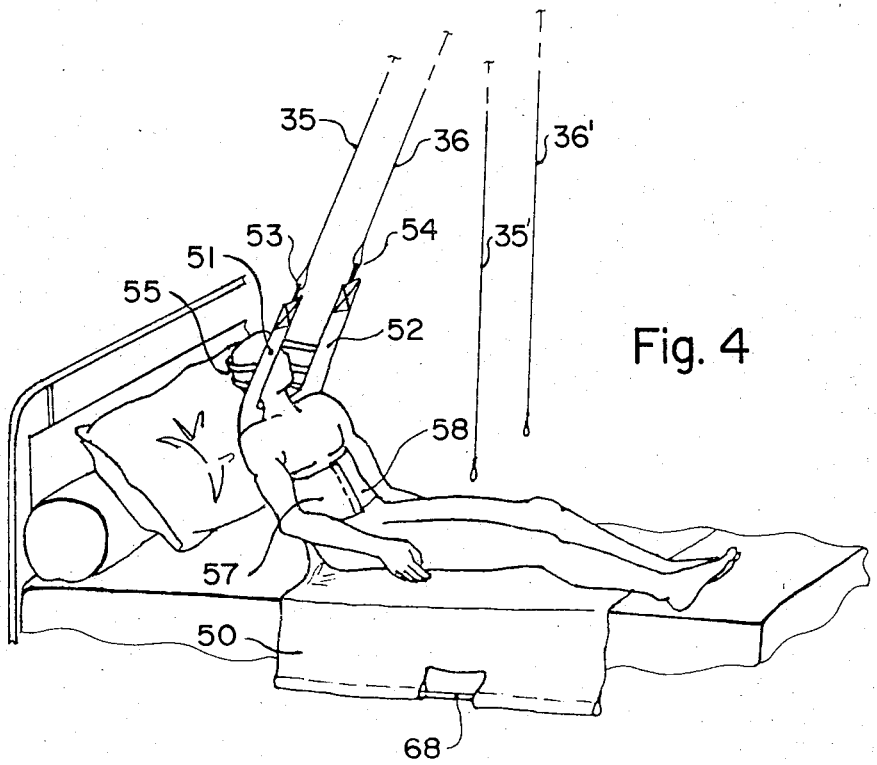

When he wishes to move, the patient firstly hooks the removable rings 53, 54 to the cables 35', 36 (FIG. 4), then buckles parts 57, 58 over his chest. By an appropriate control system (not shown), such as for example a voice control, a control incorporating resistive keys, a conventional mechanical control by handle or lever, knob, control stick, remote-control, etc. . . . , the patient may himself control the action of the lifting motor 4 which winds the cables 35, 36 and thus ensures transfer to sitting position, his head being supported by the elastic head-rest 55.

Figure 5:
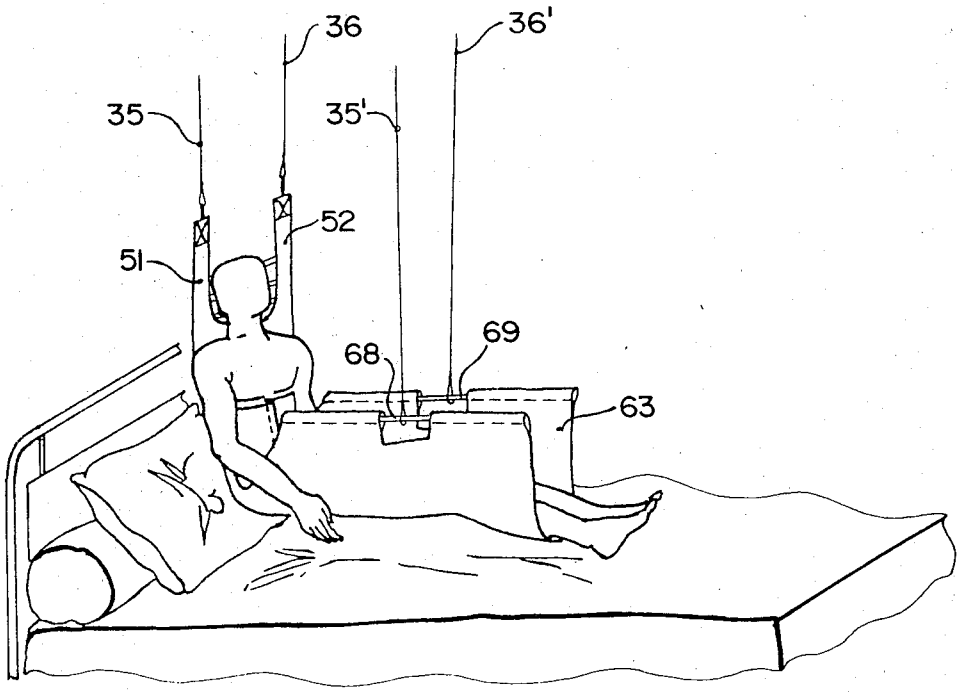
Figure 13:
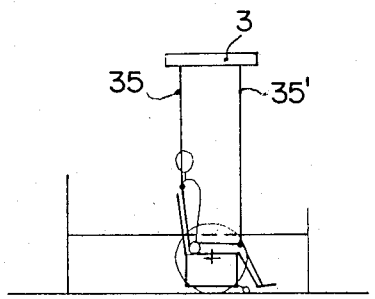

The patient may then hook the ends 35' and 36' of the cable on the rigid rods 68, 69 (cf. FIG. 5). The differentials for winding of the cables 35', 36' ensure the progressive rise, therefore the lifting of the patient from the bed. By a second conventional controlling device, the patient may ensure the control of the motor 5 for translation, so as to move to the desired spot, for example his chair, as shown in FIG. 13.

During the whole phase of transfer, the patient is therefore in a sitting position on the patient-carrier with his legs supported beyond the knee joint, which is not the case with the solutions mentioned in the preamble.

It goes without saying that all the operations may be interrupted during maneuver.

The conventional controlling devices (not shown) at the patient's or nursing staff's disposal must ensure the control:

on the one hand, of the two motors 4 and 5;

on the other hand, the variation of the speed of these two motors 4 and 5;

finally, the electrical logic of the system.

Obviously, these members must be within reach of the patient to ensure his independence. They must also comply with safety standards.

The device according to the invention presents numerous advantages over those known heretofore, particularly those of the type mentioned in the preamble.

For example:

the possibility for the patient to acquire a certain independence, therefore not to have to systematically call upon assistance from a third party;

a reliable and economical construction;

easy assembly;

the possibility of being modulated depending on the patient's handicaps and on the environment;

a manipulation requiring virtually no effort since all the transfer operations are motorized;

a position of the patient during transfer which is sure, ergonomic and comfortable;

lastly, the possibility for the patient's going into and remaining in sitting position.

In addition, the invention does not consist simply in having combined the teachings of the old British Patent No. 3894 mentioned in the preamble by adapting a supple patient-carrier thereto. In fact, the solution which would be given in that way would perhaps ensure a certain means for lifting the patient, but without ensuring holding and especially, it would not solve the problem of transfer of this patient, which is redhibitory.

Consequently, this device may have numerous applications, not only in a hospital environment, but even in a domestic situation.

What is claimed is:

1. A device for moving a patient, comprising:

a support means for receiving the patient, said support means being made from a unitary supple cloth, said support means comprising:

a first portion adapted to receive and maintain a head of the patient;

a second portion adapted to receive and maintain a main body portion of the patient; and a third portion adapted to receive and maintain legs of the patient;

a trolley comprising means for actuating cables connected to said support means for lifting said support means loaded with the patient vertically and for horizontal displacement thereof, comprising:

a first pair of cables connected to the first part of said support; and a second pair of cables connected to the third part of said support;

a lifting motor for lifting and lowering said first and second pair of cables; and a translation motor for moving said trolley horizontally; and at least one rail for displacement of said trolley thereon.

2. The device of claim 1, wherein the lifting motor is fastened on said trolley and is associated with a speed reducing gear having a driven shaft comprising two assemblies, each assembly being formed by three parallel cheeks defining two pairs of drums, upon which are wound said first and second pair of cables.

3. The device of claim 2, wherein the lifting motor actuates said first and second pair of cables, which, by a previous differential adjustment, firstly drive the first portion of said support to bring the patient into a sitting position, and then lift the third portion of said support, thus enabling the body of the patient to be lifted into a sitting position.

4. The device of claim 1, wherein said trolley moves over two transverse parallel rails having top and lateral faces, and said trolley comprises wheels for translation which roll on the top face of said rails and lateral guiding wheels which roll against the inner lateral face of said rails.

5. The device of claim 4, wherein the translation motor drives a first pulley which transmits movement by a driving belt to a second pulley mounted on a shaft fixed to said trolley, thereby connecting two of said wheels for translation of the trolley.

6. The device of claim 1, wherein the cables are supple cables.

7. The device of claim 1, wherein the device further comprises a means for controlling the lifting motor for vertical displacement of the support means and a means for controlling the translation motor for horizontal displacement of the support means.

8. A device for moving a patient, comprising:

a support means for receiving the patient, said support means being made from a unitary supple cloth, said support means comprising:

a first portion adapted to receive and maintain a head of the patient, said first portion including at least two belt portions with at least one removable ring attached to each belt portion;

a second portion adapted to receive and maintain a main body portion of the patient, said second portion including at least two projecting portions for fastening about said main body portion of the patient; and a third portion adapted to receive and maintain legs of the patient, said third portion including gussets for receiving removable rods therein;

a trolley comprising means for actuating cables connected to said support means for lifting said support means loaded with the patient vertically and for horizontal displacement thereof, comprising:

a first pair of cables connected to each of said at least one removable ring;

a second pair of cables connected to said removable rods;

a lifting motor for lifting and lowering said first and second pair of cables; and a translation motor for moving said trolley horizontally; and at least one rail for displacement of said trolley thereon.

9. The device of claim 8, wherein an elastic portion is stretched between said two belt portions for receiving the head of the patient thereon.

10. The device of claim 8, wherein the lifting motor is fastened on said trolley and is associated with a speed reducing gear having a driven shaft comprising two assemblies, each assembly being formed by three parallel cheeks defining two pairs of drums, upon which are wound said first and second pair of cables.

11. The device of claim 10, wherein the lifting motor actuates said first and second pair of cables, which, by a previous differential adjustment, firstly drive the first portion of said support to bring the patient into a sitting position, and then lift the third portion of said support, thus enabling the body of the patient to be lifted into a sitting position.

12. The device of claim 8, wherein said trolley moves over two transverse parallel rails having top and lateral faces, and said trolley comprises wheels for translation which roll on the top face of said rails and lateral guiding wheels which roll against the inner lateral face of said rails.

13. The device of claim 12, wherein the translation motor drives a first pulley which transmits movement by a driving belt to a second pulley mounted on a shaft fixed to said trolley, thereby connecting two of said wheels for translation of the trolley.

14. The device of claim 8, wherein the cables are supple cables.

15. The device of claim 8, wherein the device further comprises a means for controlling the lifting motor for vertical displacement of the support means and a means for controlling the translation motor for horizontal displacement of the support means.

* * * * *